US007316803B2

(12) United States Patent
Weber

(10) Patent No.: US 7,316,803 B2
(45) Date of Patent: Jan. 8, 2008

(54) FIBER AND CORRUGATED METAL MAT SUPPORT

(75) Inventor: Dave Weber, Toledo, OH (US)

(73) Assignee: Ford Global Technologies, LLC, Dearborn, MI (US)

( * ) Notice: Subject to any disclaimer, the term of this patent is extended or adjusted under 35 U.S.C. 154(b) by 715 days.

(21) Appl. No.: 10/708,687

(22) Filed: Mar. 18, 2004

(65) Prior Publication Data

US 2005/0207947 A1 Sep. 22, 2005

(51) Int. Cl.
*B01D 50/00* (2006.01)
*B01J 8/02* (2006.01)

(52) U.S. Cl. ..... 422/179; 422/180; 422/221

(58) Field of Classification Search ..... 422/179, 422/180, 181, 221, 222; 428/116
See application file for complete search history.

(56) References Cited

U.S. PATENT DOCUMENTS 4,163,042 A * 7/1979 Lynch ..... 422/179
5,800,905 A 9/1998 Sheridan et al.
5,811,063 A 9/1998 Robinson et al.
6,024,928 A 2/2000 Foster
6,231,818 B1 5/2001 TenEyck
6,245,301 B1 * 6/2001 Stroom et al. ..... 422/179
2002/0127154 A1 * 9/2002 Foster et al. ..... 422/179

FOREIGN PATENT DOCUMENTS

WO WO 91/07242 5/1991

* cited by examiner

*Primary Examiner*—Walter D. Griffin
*Assistant Examiner*—Frank C Campanell
(74) *Attorney, Agent, or Firm*—Damian Porcari; Brooks Kushman P.C.

(57) ABSTRACT

The present invention discloses a support for securely holding an exhaust catalyst in a combustion and exhaust system. The support of the invention includes a flexible refractory mat adapted to surround the exhaust catalyst and a metal foil having a plurality of protrusions disposed over the flexible refractory mat. The present invention also discloses an exhaust system in which a catalyst is held in place with the support of the invention. Finally, methods for securing a catalyst to an exhaust system are provided.

27 Claims, 3 Drawing Sheets

FIBER AND CORRUGATED METAL MAT SUPPORT

BACKGROUND OF INVENTION

1. Field of the Invention

In at least one aspect, the present invention provides an improved support for a catalyst placed within an exhaust system.

2. Background Art

Virtually every modern automobile contains an exhaust system for removing various environmentally harmful byproducts of an internal combustion engine. Also, many combustion furnaces, and electrical generators use catalytic convertors. Typically, various catalysts are used to accomplish this removal. These catalysts are exposed to a wide range of temperatures from below freezing up to several hundred degrees Fahrenheit. An important requirement in the design of exhaust systems is the mounting of a support of the catalyst. The material selection for these support systems must securely hold the catalyst in place at all temperatures to which the catalyst is exposed.

Several methods exist for supporting exhaust catalysts in an exhaust system. For example, knitted wire mesh supports or mat supports have been used to securely hold exhaust catalysts in place. The knitted wire mesh support has a lower maximum use temperature and a lower thermal insulating value. Moreover, knitted wire mesh supports tend to be expensive. Therefore, it is only used for applications where the temperature is so low and the use of mat is precluded.

Mat supports are ideal from many standpoints except cold holding ability. Such mat supports often contain a vermiculite popping filler that requires >500° F. for an extended time to expand the filler and cause a compressive force on the substrate. Mat supports without filler (non-intumescent type) also exist, but these supports are more expensive and harder to process to a minimum substrate holding pressure.

In another variation, an exhaust catalyst is supported by a fiber mat interwoven into a knitted wire mesh. This design is used to improve the thermal insulating value (i.e. reduce shell temperatures for heat management). However, this design is even more expensive than knitted wire mesh supports. In another prior art design, a corrugated metal inner liner is inserted into a pocket cut into a mat support. The corrugated metal is not on the outer part of the support, but on the inside. Its function is to prevent abrasion of the ceramic fiber mat in a space between two non-butted substrates and provide support for the catalyst. The purpose of the corrugation is to prevent sagging of the metal at high temperatures. However, the use of this last design is somewhat undesirable for catalyst support systems because the sandwiching of the corrugated metal greatly reduces its resiliency.

Accordingly, there exists a need in the prior art for improved catalyst supports that have a wider useful temperature range.

SUMMARY OF INVENTION

The present invention overcomes the problems of the prior art by providing a combustion exhaust catalyst support for holding an exhaust catalyst in an exhaust system with a wide useful temperature range. The support of the invention includes a flexible refractory mat adapted to surround the exhaust catalyst and a metal foil having a plurality of protrusions disposed over the flexible refractory mat. The catalyst support is relatively inexpensive because forming protrusions in metal foil is an uncomplicated procedure especially when compared to forming knitted wire mesh. Moreover, because a refractory mat is also used, the support of the present invention has excellent thermally insulating properties. The catalyst support of the present invention is particularly useful for support of an automobile exhaust catalyst in an automobile exhaust system.

In another embodiment of the invention, an exhaust system in which a catalyst is held in place with the support of the invention is provided.

In yet another embodiment of the invention, methods for securing a catalyst to an exhaust system are provided.

DETAILED DESCRIPTION

Reference will now be made in detail to presently preferred compositions or embodiments and methods of the invention, which constitute the best modes of practicing the invention presently known to the inventors.

Figure 1A:
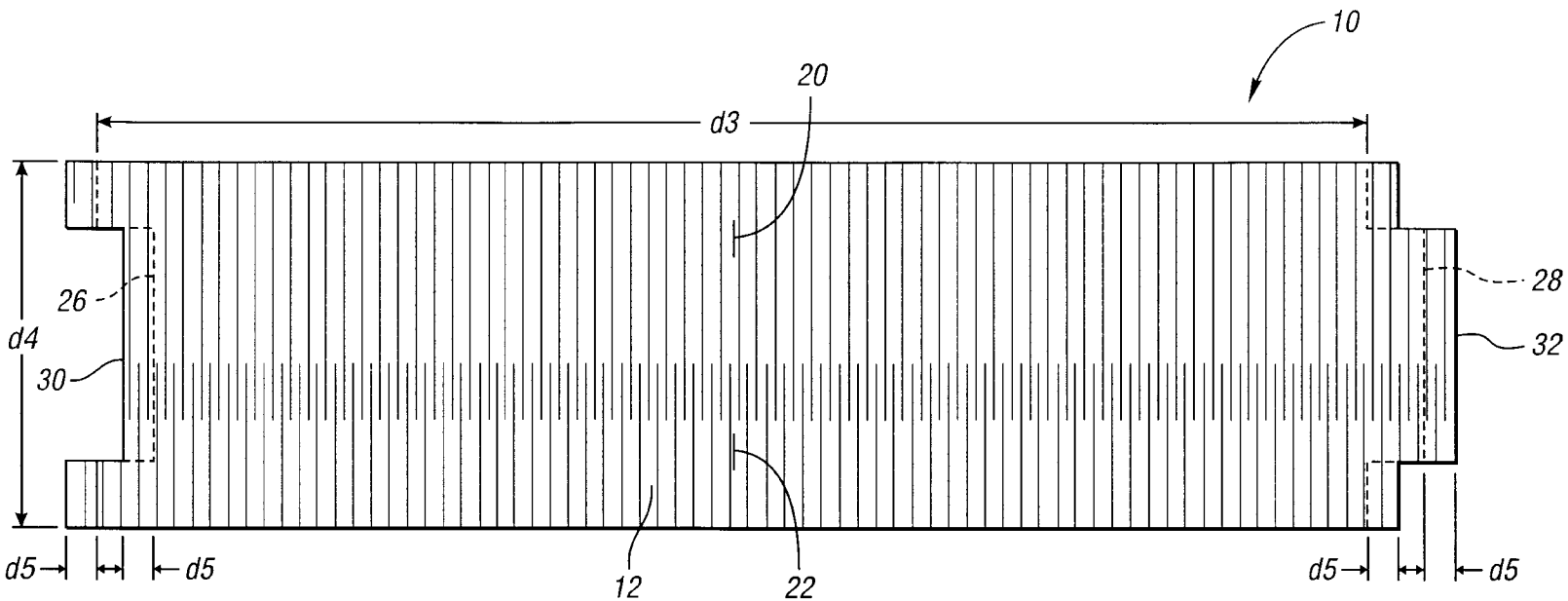
FIG. 1*a* is a top view of the catalyst support of the present invention prior to assembly.
Figure 1B:
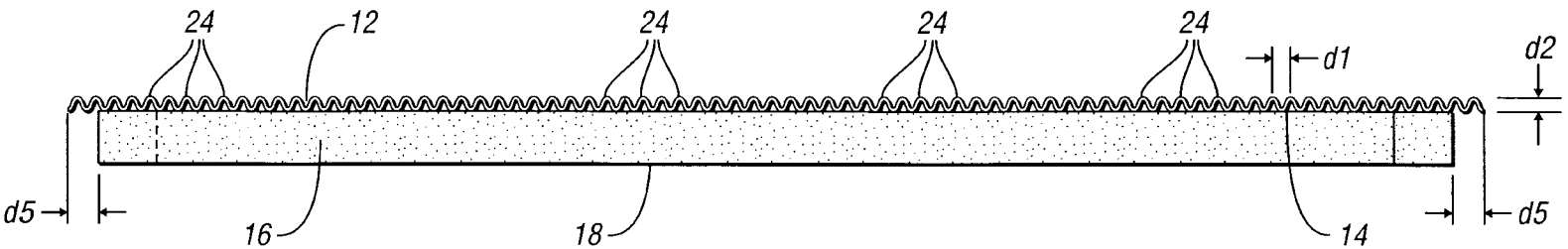
FIG. 1*b* is a side view of a catalyst support of the present invention prior to assembly.

With reference to FIGS. 1*a* and 1*b* a top view and a side view of the catalyst support of the present invention are provided. In these figures, views of the support are provided before placement around a catalyst. Catalyst support 10 includes metal foil 12 which is placed over surface 14 of refractory mat 16. In FIG. 1*a* refractory mat 14 is shown in phantom view. Optionally, a thin organic film (not shown) may be interposed between metal foil 12 and refractory mat 16. Such an organic film is used to reduce the cracking of the outer surface of the mat and to improve the tensile strength of the mat. Refractory mat 16 also includes second surface 18 which is contacted to an exhaust catalyst. Metal foil 12 is optionally fastened to refractory mat 16 by refractory staples 20, 22 positioned near the center. Alternatively, metal foil 12 may be fixed to refractory mat 16 by other means, which include organic glues, rubber bands, tape, and the like. Moreover, metal mat 12 includes corrugations 24 which provide springiness or resiliency to the support of the present invention. Corrugations 24 may further be defined by the distance d1 between successive peaks and the height d2 from top to bottom. The selection of these values will be predicated on the type of metal used, the metal thickness, and the amount of resiliency desired. Useful values for d1 are several millimeters, typically from about 1 to 5 mm with a value of about 3 mm being preferred. Similarly, height d2 will be several mm, typically from about 1 to about 5, with 3 being preferred.

Metal foil 12 may be made of any suitable metal which can withstand the temperatures and chemical environment of a combustion exhaust system. Suitable metals include, but are not limited to, stainless steels, nickel alloys, and cobalt alloys. More specific metals meeting the requirements for metal foil 12 are monels, hastelloys, inconels, 300 series stainless steels, and 400 series stainless steels. Inconel X750 is particularly useful for this application. Metal foil 10 may be made by a number of techniques known to one skilled in the art. For example, a sheet of metal foil is cut into a shape that when corrugated and wrapped in a hoop shape, will fit the inside of a converter shell (i.e., the housing that contains the exhaust catalyst.) The metal sheet is then corrugated in a crimping roller machine. Corrugations 24 in metal sheet 10 may be described as being approximately sinousoidal or triangular-shaped in cross section. However, any shape may be used so long as the resulting metal foil 12 have sufficient resiliency (i.e., spring-like properties) that when compressed in a plane normal to refractory mat 16 it will tend to restore its original shape. Accordingly, metal foil 12 may have other types of protrusions instead of corrugations. For example, metal foil 12 may have square corrugations, circular corrugations, flattened shingle-like corrugations, or dimples. Finally, metal foil 10 will typically be from about 0.01 millimeters to about 0.5 millimeters thick. More preferably, metal foil 10 is from about 0.01 millimeters to about 0.2 millimeters thick.

Refractory mat 16 is preferably a ceramic fiber mat. Refractory mat 16 is made in the conventional way using a blend of ceramic fibers organic binders, and optionally tumescent materials (e.g. vermiculite). It is die-cut in the conventional way so that length d3 is slightly shorter than the corrugated metal shape by a distance two times d5. This shorter length is needed because the material is formed later to be toward the inside of the converter, so the periphery is smaller. The thickness of refractory mat 16 will typically be several millimeters. Preferably, the thickness of refractory mat 16 is from about 3 to 10 mm. More preferably, refractory mat 16 is from about 4 to 8 mm, and most preferably, refractory mat 16 is about 6 mm.

Still referring to FIGS. 1*a* and 1*b*, refractory mat 16 also includes optional notch 26 and optional extension 28 which are mated together when catalyst support 10 is placed over an exhaust catalyst. Similarly, metal foil 12 also includes optional notch 30 and optional extension 32 which are mated together when catalyst support 10 is placed over an exhaust catalyst. The exact dimensions of catalyst support 10 will depend on the dimensions and number of catalysts to be supported. Width d3 will be such that, when catalyst support 10 may be wrapped completely around a catalyst, length d4 will be of a sufficient size to hold one or more catalysts. For example, if two catalyst flow-thru substrates that are 152 millimeters diameter X 122 millimeters length are used with a gap of 40 millimeters between substrates, width d3 will be about 500 millimeters and length d4 will be about 250 millimeters if seals are used and about 280 millimeters if seals are not used.

Figure 2:
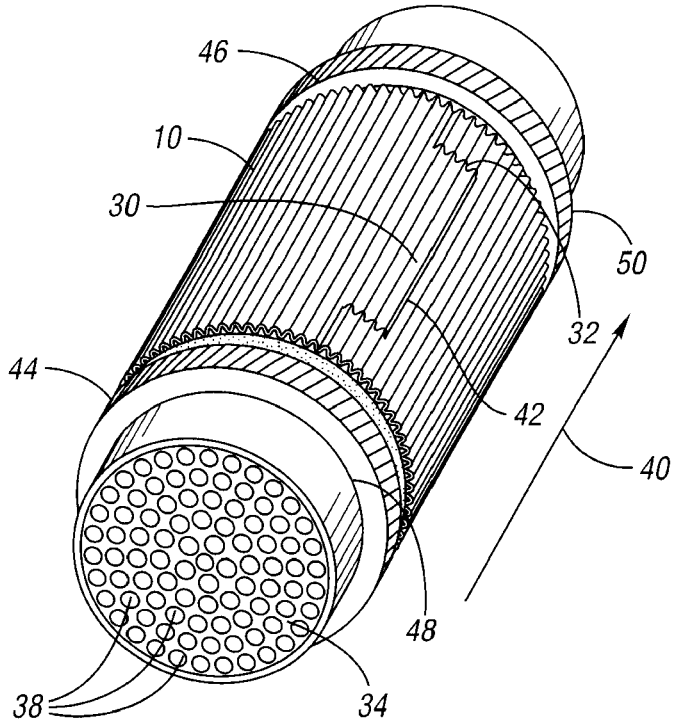
FIG. 2 is a perspective cross-sectional view of the catalyst support of the present invention placed over an exhaust catalyst.

In another embodiment of the present invention, an exhaust system in which a catalyst is held in place by the catalyst support of the present invention is provided. This embodiment includes the support of the invention wrapped around an exhaust catalyst with the metal foil facing outward. This combination of support and catalyst is positioned in a metal tube which is adapted for inclusion in an exhaust system such as an automobile exhaust system. With reference to FIGS. 2, a perspective cross-sectional view of the catalyst support of the present invention placed over a catalyst is provided. In this figure, catalyst support 10 surrounds catalyst 34. Catalyst 34 includes a plurality of channels 38 which traverse the entire length of catalyst 34 in a direction substantially parallel to direction 40. Exhaust catalyst 34 typically comprises a refractory brick having a longitudinal axis, a surface substantially parallel to the longitudinal axis, a front surface, and a back surface. The refractory brick may have any shape, but a substantially circular or substantially elliptical cross-section are the most common. Channels 38 run from the front surface to the back surface. The longitudinal axis of exhaust catalyst 34 is parallel to direction 40. Moreover, it is the outer surface substantially parallel to the longitudinal axis to which the first surface of the refractory mat is adjacent. Notch 30 and extension 32 of the outer metal foil 12 and the inner refractory mat 16 (not visible) are mated together at position 42. One or both of seals 44, 46 are placed at position 48, 50 to prevent exhaust gases from bypassing the catalyst. Typically, such seals are compressed knitted metal ceramic fiber. These seals are needed to prevent exhaust gas from leaking through the corrugations thus bypassing the catalyst. (These seals are needed many times anyway to protect the ceramic fiber mat support from the abrasion of the mat to the pulsating exhaust gas.) Alternatively, there are designs of mat support that do not require seals (due to their higher abrasion resistance.) In such designs, either the corrugated support must be made of a smaller width than the mat support (i.e. have fiber mat at each end without a corrugated metal foil backing) or the metal foil can have uncorrugated (i.e. flat) areas of support at each end.

Figure 3:
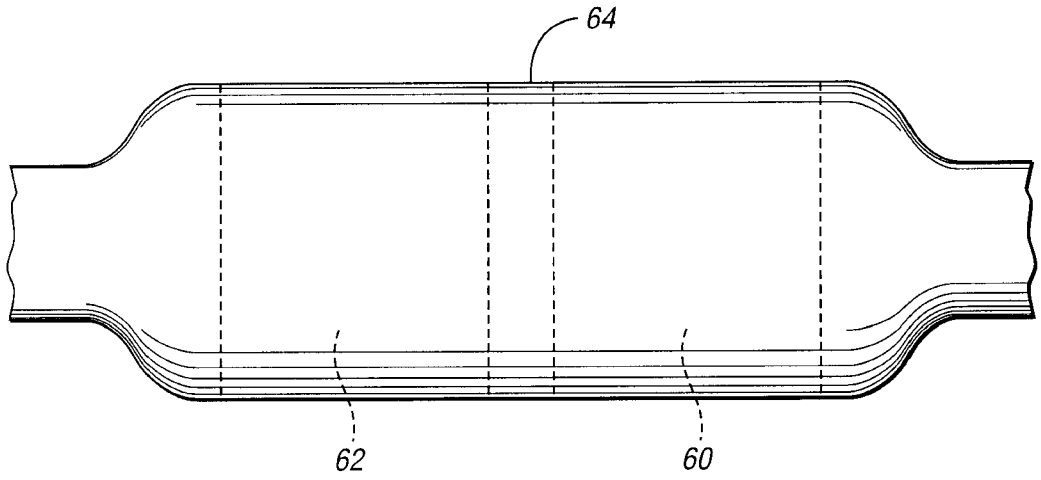
FIG. 3 is a top view of a catalytic convertor that fixtures the catalyst(s) and support(s).
Figure 4:
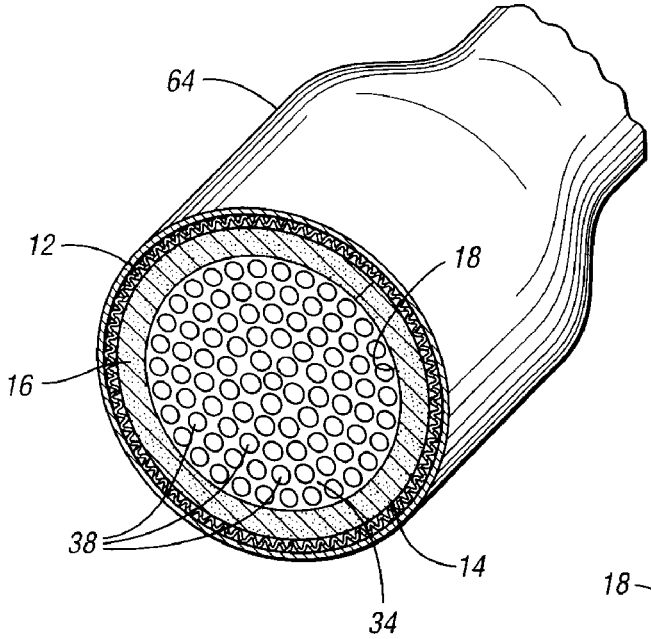
FIG. 4 is a perspective cross-sectional view of an exhaust catalyst being supported in a metal tube adapted for inclusion in an exhaust system that was constructed using the "stuffing" or the stuffing and swaging process.
Figure 5:
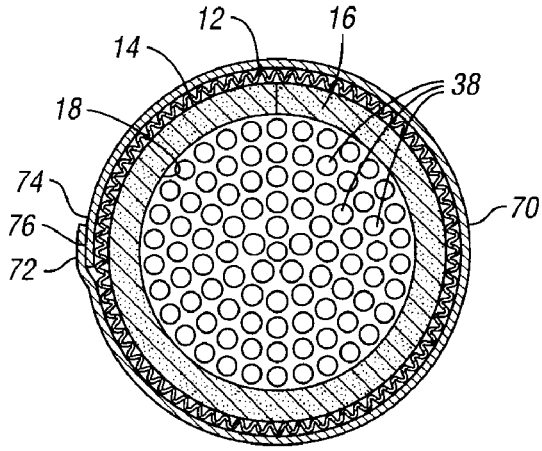
FIG. 5 is a cross-sectional view of an exhaust catalyst supported in a metal tube constructed by the "tourniquet method"
Figure 6:
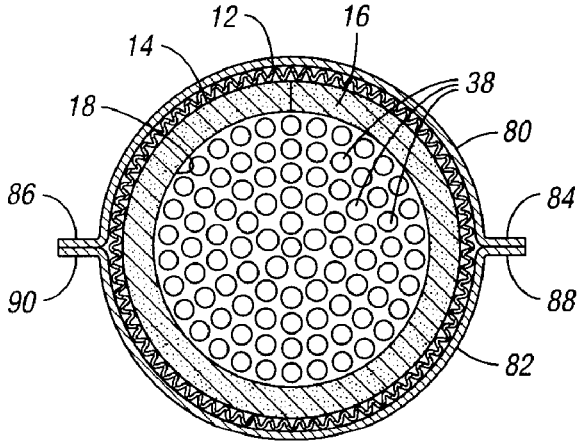
FIG. 6 is a cross-sectional view of an exhaust catalyst supported in a metal tube constructed by the "clam shell method"
Figure 7:
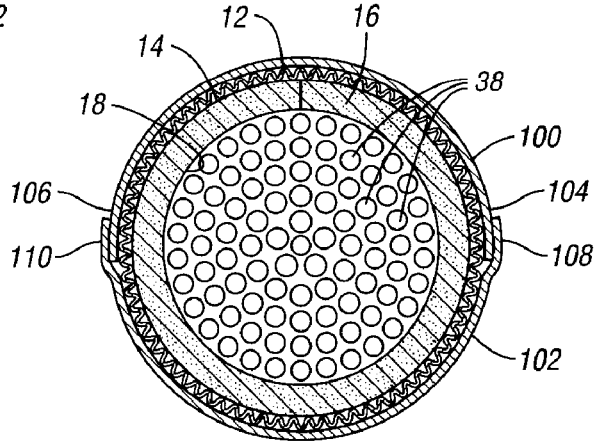
FIG. 7 is a cross-sectional view of an exhaust catalyst supported in a metal tube constructed by the "shoebox method."

With reference to FIGS. 3, 4, 5, 6 and 7, the placement of a catalyst in a metal tube to form a catalytic convertor adapted for placement in a combustion exhaust system is described. FIG. 3 provides a top view (or side view) of the placement of an exhaust catalyst and the catalyst support of the present invention placed in a metal tube that may be included in an exhaust system. Combinations 60, 62 of the combination of catalyst 34, support system 10, and optional seals 48, 46 are shown in phantom view placed in metal tube 64. FIG. 4 provides a perspective cross-sectional view of an exhaust catalyst being supported in a metal tube adapted for inclusion in an exhaust system that is processed using a stuffing operation into a tube (with or without a subsequent swaging operation). Exhaust catalyst 34 is surrounded by refractory mat 16 which is in turn surrounded by corrugated metal foil 12. The combination of catalyst 34, mat 16 and corrugated metal foil 12 is placed within metal tube 64. The catalyst 34 is held in the metal tube 64 at surface 18 by the resilient spring force of both the refractory mat 16 and the corrugated metal 12. The metal tube 64 pushes inward against the corrugated metal 12, which performs like a spring. The corrugated metal 12 then pushes inward against the mat 16 at surface 14. FIG. 5 provides a cross-sectional view of an exhaust catalyst supported in a metal tube constructed by the tourniquet method. In this variation, exhaust catalyst 34 is surrounded by refractory mat 16 which is in turn surrounded by corrugated metal foil 12. The combination of catalyst 34, mat 16 and corrugated metal foil 12 is placed within open metal tube 70. Open metal tube 70 includes flanges 72, 74. After the combination of catalyst 34, mat 16 and corrugated metal foil 12 is placed within open metal tube 70, open metal tube 70 is compressed such that flange 72 slides over flange 74, which are subsequently welded together at position 76. FIG. 6 is a cross-sectional view of an exhaust catalyst supported in a metal tube constructed by the "clam shell method." In this variation, exhaust catalyst 34 is surrounded by refractory mat 16 which is in turn surrounded by corrugated metal foil 12. The combination of catalyst 34, mat 16 and corrugated metal foil 12 is placed within the cavity of flanged tube half 82. The converter is formed by pressing flanged tube half 80 to flanged tube half 82. Flanged tube half 80 includes flanges 84, 86 and flanged tube half 82 includes flanges 88, 90. Moreover, flanges 84, 86 are adapted to abut against flanges 88,90. A seal between the flanges may be made by welding or alternatively, the flanges may be clamped or bolted together with an optional sealant between them. FIG. 7 is a cross-sectional view of an exhaust catalyst supported in a metal tube constructed by the "shoebox method." In this variation, exhaust catalyst 34 is surrounded by refractory mat 16 which is in turn surrounded by corrugated metal foil 12. The combination of catalyst 34, mat 16 and corrugated metal foil 12 is placed within the cavity of flanged tube half 102. The converter is formed by pressing flanged tube half 100 to flanged tube half 102. Flanged tube half 100 includes flanges 104, 106 and flanged tube half 102 includes flanges 108, 110. Moreover, flanges 104, 106 are adapted to slide past flanges 108,110 prior to welding. The process for making the catalytic convertor of FIG. 7 is similar to the process for FIG. 6. The process of FIG. 7, though, typically can press to a pressure instead of pressing to a physical stop as in FIG. 6.

In another embodiment of the present invention, a method of supporting a combustion exhaust catalyst is provided. The method of this embodiment utilizes the catalyst support and mat set for above and is particularly useful for supporting an automobile exhaust catalyst in an automobile exhaust system. The method comprises placing a flexible refractory mat having a first surface and a second surface over a surface of an exhaust catalyst wherein the first surface is adjacent to the surface of the exhaust catalyst. Next, a metal foil having a plurality of protrusions is placed over the second surface of the refractory mat to form a catalyst-support combination. Alternatively, the metal foil may be placed over the second surface of the refractory mat prior to the placing of the refractory mat over the surface of the exhaust catalyst. In this latter variation, the metal foil and refractory mat are attached together as set forth above. The ends of the catalyst support can be held together with tape, organic glue, etc. to temporarily hold the support until the convertor is welded. The catalyst internal sub-assembly (i.e., the combination of the catalyst brick and the catalyst support) is then placed into a metal tube to form the catalytic converter in the conventional way (e.g. shoebox—sliding joints clamp and weld; clamshell—butted joints clamped and welded; stuffing a tube and swaging to reduce the outer diameter; tourniquet-one sliding joint, clamp and weld). The metal tube is adapted to be placed within a combustion exhaust system such as a vehicle exhaust system. The selection of the materials for the refractory mat and the metal foil as well as the shapes and thicknesses of these materials is the same as set forth above. Specifically, the plurality of protrusions within the metal foil comprise a plurality of ridges and grooves such that the metal foil is corrugated or alternatively, comprise a plurality of dimples.

A number of methods of placing the catalyst-support combination within the metal tube may be employed. For example, the catalyst-support combination may be slipped in the metal tube followed by swaging down on the metal tube until the catalyst-support combination is held in place (FIG. 4). If this swaging operation is performed, it must be performed with sufficient force to securely hold the catalyst in place at both high and low temperatures. In the process of applying pressure during swaging, the mat deforms to fit into the valleys of the corrugated metal foil and the converter shell compresses the corrugated foil and deforms it. The residual spring force from the corrugated metal foil depends on the metal material, the foil thickness, the corrugation design, the foil temper hardness, and on the mat properties. The metal foil parameters above are adjusted to give the correct spring force or pressure on the substrate (i.e. low enough so that the substrate isn't crushed, but high enough to compensate for shell expansions, catalyst expansions, changes to mat properties, converter vibration forces and exhaust back pressure against the catalyst.)

Another method for placing the catalyst-support combination within the metal tube is the so-called "tourniquet method." With reference to FIG. 5, metal tube 70 is initially open and has flanges 72, 74. The catalyst-support combination is placed with the central cavity of metal tube 70. Metal tube 70 is then compressed so that flange 72 slides past and contacts flange 74. A seal is then formed at position 76. Another method for placing the catalyst-support combination within the metal tube is the so-called "clam shell method." With reference to FIG. 6, catalyst-support combination is placed within the cavity of flanged tube half 82. Flanged tube half 80 is then joined to flanged tube half 82 using pressure/clamp force. Flanged tube half 80 includes flanges 84, 86 and flanged tube half 82 includes flanges 88, 90. A seal between the flanges is then made by welding or alternatively, the flanges are clamped or bolted together with an optional sealant between them. With reference to FIG. 7, catalyst-support combination is placed within the cavity of flanged tube 102. Flanged tube half 100 is then joined to flange tube half 102. Flanged tube half 102 includes flanges 108, 110 and flanged tube half 100 includes flanges 104, 106. The advantage of the sliding flanges 108, 110, 104, 106 is that they allow pressing to a pressure. This reduces the tolerance of the supports 12, 16 spring force. A seal between the flanges is then made by welding or alternatively, the flanges are brazed, clamped or bolted together with an optional sealant between them. In each of the alternative methods, the combination of the catalyst and catalyst support is placed in the metal tube under compressive forces. The requirements of these forces is the same as set forth above.

While the best mode for carrying out the invention has been described in detail, those familiar with the art to which this invention relates will recognize various alternative designs and embodiments for practicing the invention as defined by the following claims.

The invention claimed is:

1. A combustion exhaust catalyst support adapted to hold an exhaust catalyst in an exhaust system, the support comprising:

a flexible refractory mat having a first surface and a second surface, the flexible refractory mat adapted to surround the exhaust catalyst with the first surface being adjacent to a surface of the exhaust catalyst; and a metal foil having a plurality of protrusions, the metal foil disposed over the second surface of the flexible refractory mat, wherein the metal foil is between about 0.01 millimeters to about 0.5 millimeters thick.

2. The support of claim 1 wherein the plurality of protrusions comprise a plurality of ridges and grooves such that the metal foil is corrugated.

3. The support of claim 1 wherein the plurality of protrusions comprise a plurality of dimples.

4. The support of claim 1 wherein the metal foil comprises a metal selected from the group consisting of stainless steels, nickel alloys, and cobalt alloys.

5. The support of claim 4 wherein the metal foil comprises a metal selected from the monels, hasteloys, inconels, 300 series stainless steels, and 400 series stainless steels.

6. The support of claim 1 wherein the metal foil is between about 0.01 millimeters to about 0.2 millimeters thick.

7. The support of claim 1 wherein the refractory mat comprises refractory ceramic fiber and a binder.

8. The support of claim 1 wherein the refractory mat is adapted to surround an exhaust catalyst comprising a refractory brick having a longitudinal axis, a surface substantially parallel to the longitudinal axis, a front surface, and a back surface, the refractory brick comprising a series of channels substantially parallel to the longitudinal axis which pass through the refractory brick.

9. The support of claim 8 wherein the first surface of the refractory mat is adjacent to the surface substantially parallel to the longitudinal axis.

10. The support of claim 9 wherein the refractory brick has a substantially circular or substantially elliptical cross-section.

11. The support of claim 1 wherein the metal foil includes a first end with a metal foil notch and a second end with a metal foil protrusion and the refractory mat includes a first end with a refractory mat notch and a second end with a refractory mat protrusion wherein the metal foil notch and metal foil protrusion are adapted to mate together and the refractory mat notch and refractory mat protrusion are adapted to mate together so that the support when placed around the exhaust catalyst is held in place.

12. An exhaust system comprising:

an exhaust catalyst;

a flexible refractory mat having a first surface and a second surface, the flexible refractory mat surrounding the exhaust catalyst with the first surface being adjacent to a surface of the exhaust catalyst; and a metal foil having a plurality of protrusions, the metal foil disposed over the second surface of the flexible refractory mat, wherein the metal foil is between about 0.01 millimeters to about 0.5 millimeters thick.

13. The exhaust system of claim 12 wherein the plurality of protrusions comprise a plurality of ridges and grooves such that the metal foil is corrugated.

14. The exhaust system of claim 12 wherein the plurality of protrusions comprise a plurality of dimples.

15. The exhaust system of claim 12 wherein the exhaust catalyst comprises a refractory brick having a longitudinal axis, a surface substantially parallel to the longitudinal axis, a front surface, and a back surface, the refractory brick comprising a series of channels substantially parallel to the longitudinal axis which pass through the refractory brick.

16. The exhaust system of claim 15 wherein the first surface of the refractory mat is adjacent to the surface substantially parallel to the longitudinal axis.

17. The exhaust system of claim 16 wherein the refractory brick has a substantially circular or substantially elliptical cross-section.

18. The exhaust system of claim 12 wherein the metal foil includes a first end with a metal foil notch and a second end with a metal foil protrusion and the refractory mat includes a first end with a refractory mat notch and a second end with a refractory mat protrusion wherein the metal foil notch and metal foil protrusion are adapted to mate together and the refractory mat notch and refractory mat protrusion are adapted to mate together so that the support when placed around the exhaust catalyst is held in place.

19. The exhaust system of claim 12 wherein the metal foil comprises a metal selected from the group consisting of stainless steels, nickel alloys, and cobalt alloys.

20. The exhaust system of claim 15 wherein the metal foil comprises a metal selected from the monels, hasteloys, inconels, 300 series stainless steels, and 400 series stainless steels.

21. The exhaust system of claim 12 wherein the refractory mat comprises refractory ceramic fiber and a binder.

22. A method of supporting an exhaust catalyst, the method comprising:

placing a flexible refractory mat having a first surface and a second surface over a surface of an exhaust catalyst wherein the first surface is adjacent to the surface of the exhaust catalyst;

placing a metal foil having a plurality of protrusions and a thickness of between about 0.01 millimeters to about 0.5 millimeters over the second surface of the refractory mat to form a catalyst-support combination; and securely placing catalyst-support combination within a metal tube, the metal tube adapted to be placed within an exhaust system.

23. The method of claim 22 wherein the plurality of protrusions comprise a plurality of ridges and grooves such that the metal foil is corrugated.

24. The method of claim 22 wherein the plurality of protrusions comprise a plurality of dimples.

25. The method of claim 22 wherein the catalyst-support combination is placed with a metal tube by sliding the catalyst-support combination in the metal tube and then swaging down on the metal tube until the catalyst-support combination is held in place.

26. The method of claim 22 wherein the metal tube has a pair of flanges and the catalyst-support combination is placed with a metal tube positioning the catalyst-support combination in the metal tube, compressing the metal tube so that the pair of flanges come in contact, and sealing the pair of flanges together.

27. The method of claim 22 wherein the metal tube comprises a first tube half and a second tube half so that the catalyst-support combination is placed in the metal tube by positioning the catalyst-support combination in a cavity formed by bringing the first tube half and the second tube half together.

* * * * *